United States Patent [19]

Devorak

[11] Patent Number: 4,884,811

[45] Date of Patent: Dec. 5, 1989

[54] PUZZLE APPARATUS

[76] Inventor: Dora Devorak, 1749 Lexington St., El Cerrito, Calif. 94530

[21] Appl. No.: 265,937

[22] Filed: Nov. 2, 1988

[51] Int. Cl.[4] ..... A63F 9/12; G09B 27/08

[52] U.S. Cl. ..... 273/157 A; 434/134; 434/145; 434/147

[58] Field of Search ..... 273/157 R, 157 A; 434/134, 145, 147

[56] References Cited

U.S. PATENT DOCUMENTS

| | | | |
|---|---|---|---|
| 2,600,951 | 6/1952 | Edwards | 273/295 |
| 3,618,955 | 11/1971 | Barnes | 273/157 R |
| 3,851,884 | 12/1974 | Myller | 273/157 R |

FOREIGN PATENT DOCUMENTS

| | | | |
|---|---|---|---|
| 1249868 | 10/1971 | United Kingdom | 273/157 R |
| 2185844 | 7/1987 | United Kingdom | 273/157 R |

*Primary Examiner*—Anton O. Oechsle

*Attorney, Agent, or Firm*—Bielen & Peterson

[57] ABSTRACT

A puzzle apparatus utilizing a curved member having a convex outer surface and a concave inner surface. A plurality of interlocking pieces are employed, each possessing a concave surface conforming to the convex outer surface of the curved member. Each of the multiplicity of pieces includes a convex surface displaying indicia. The plurality of interlocking pieces are held to the curved outer surface to form a rendition.

3 Claims, 1 Drawing Sheet

PUZZLE APPARATUS

BACKGROUND OF THE INVENTION

The present invention relates to a novel puzzle apparatus.

Graphical representations such as geographical maps, geological maps, historical maps, and the like have been formed into flattened, 2-dimensional puzzles. Unfortunately, the relationship of such representation to the true global arrangement is not readily apparent. It has also been found that students, especially children, easily learn geographical and geological maps by working with puzzles. Also, global projections onto a flat surface (mecator, conical and the like) distort the relative size of geographical and geological features, in addition, the concept of latitude and longitude is often misleading or inaccurate when taken from an actual global environment and placed on a flat projection.

A puzzle apparatus which transforms 2-dimensional maps into a 3-dimensional format would be a great advance in the educational field.

SUMMARY OF THE INVENTION

In accordance with the present invention a novel and useful puzzle apparatus is provided.

The puzzle apparatus of the present invention utilizes a curved member having a convex outer surface and a concave inner surface. The curved member may be a spheroid or a portion of a spheroid. The curved member may also be transparent or translucent, including a source of light placed adjacent the concave surface of the curve member. Thus, light would shine through the curved member and through the convex surface thereof.

The apparatus also embraces the provision of a plurality of interlocking pieces. Each of the plurality of interlocking pieces includes a concave surface conforming to the convex outer surface of the curved member. Further, each interlocking piece possesses a convex surface having indicia thereon such that the interlocking pieces may be formed into a map or other pictorial representation composed by the convex (indicia bearing) outer surfaces of the interlocking pieces. Again, each of the plurality of the interlocking pieces may be translucent to allow transmission of light from the light source within the curved member.

Means may also be provided for holding each of the plurality of interlocking pieces to the convex surface. Such means may take the form of a simple mechanical support where interlocking pieces rest on base surrounding and supporting the curved member. In addition, such holding means may take the form of a plurality of magnetic strips which criss-cross the curved member, preferably along the concave surface thereof. Each of the plurality of interlocking pieces would be included with a portion of magnetic material which would permit the same to affix to the curved member convex surface by the attraction of magnetic strips. Where the curved member and the interlocking pieces are translucent, the magnetic strips would form a silhouette on the outer surface of the curved member and the outer convex surface of the plurality of the interlocking pieces; such silhouette representing longitude and latitude lines of the earth.

Further, lines may be etched or otherwise placed in the convex surface of the curved member to aid the user in placing the plurality of interlocking pieces thereupon.

It may be apparent that a novel and useful puzzle apparatus has been described.

It is therefore an object of the present invention to provide a puzzle apparatus which conveys a global graphical display of a map.

Another object of the present invention is to provide a puzzle apparatus which may be employed as a learning tool and is applicable to geographical, historical, and/or physical characteristics of the known universe.

Yet another object of the present invention is to provide a puzzle apparatus which may be easily assembled and disassembled on a curved surface.

A further object of the present invention is to provide a puzzle apparatus which may be assembled on a curved surface and includes light projection means for silhouetting meridians and parallels of latitude on the outer surface of the apparatus.

The invention possesses other objects and advantages especially as concerns particular characteristics and features thereof which will become apparent as the specification continues.

For a better understanding of the invention reference is made to the following detailed description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which should be used in conjunction with the prior described drawings.

Figure 1:
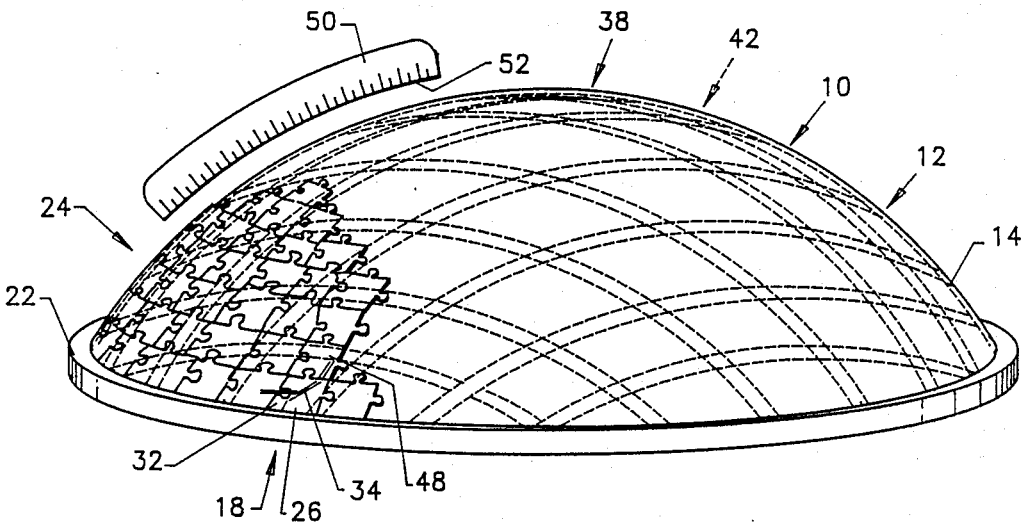
FIG. 1 is a side elevational view of the apparatus of the present invention.
Figure 3:
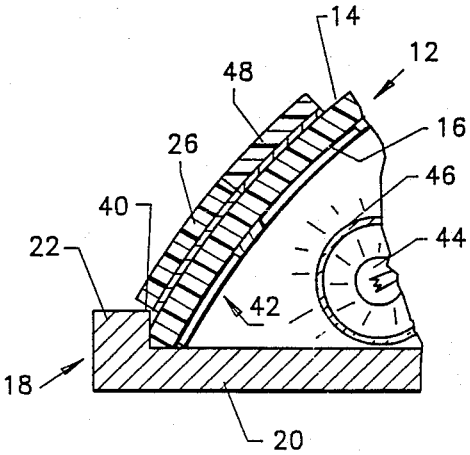
FIG. 3 is a sectional view taken across a portion of the apparatus depicted in FIG. 1.

The invention as a whole is depicted in the drawings by reference character 10. The puzzle apparatus 10 includes as one of its elements a curved member 12 which may be a spheriodal object. As depicted in FIG. 1, curved member 12 is shown as a section of a sphere. Curved member 12 may be constructed of any suitable material such a plastic, metal, wood, and the like. In certain embodiments, curved member 12 may be translucent or transparent such that plastic or glass would be the preferred material for its construction. Curved member 12 includes a convex outer surface 14 and a concave inner surface 16, FIGS. 1 and 3. Curved member 12 rests on a base 18 that includes a bottom plate 20 with an upwardly extending shoulder 22 that extends around the lower extremity of curve member 12.

Figure 2:
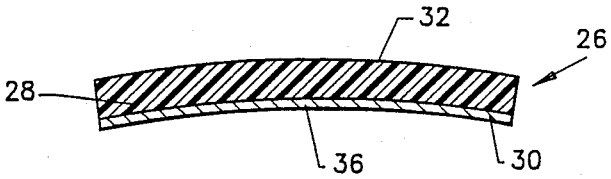
FIG. 2 is a sectional view of a single interlocking piece employed in the present invention in FIG. 1.

Apparatus 10 also includes as one of its elements a plurality of interlocking pieces 24. FIG. 2 depicts a typical piece 26 of plurality of pieces 24 as depicted in FIG. 2. Piece 26 includes a body portion 28 having a concave inner surface 30 and an convex outer surface 32. Convex surface 32 includes indicia 34 which combined with indicia on the remaining multiplicity or plurality of interlocking pieces 24, such as piece 48, to form a graphical representation e.g. a map and the like. Inner surface 30 of piece 26 serves to support a strip of material which may have magnetic properties e.g. finely divided metal formed in plastic or glass. Thus, strip 36 may be also translucent or transparent.

The apparatus 10 may further include means 38 for holding each of the plurality of the interlocking pieces 24 to convex surface 14 of curved member 12. Such means may simply take the form of plurality of pieces 24 resting atop edge 40 of shoulder 22. In this case, plurality of interlocking pieces 24 would be extended upwardly from base 22 in building-block style. Of course, the outline of each of the plurality of pieces 24 may be etched or otherwise marked in outer surface 14 of curve member 12 to aid in the assemblage thereof.

Means 38 may also take the form of placing a plurality of strips 42 of magnetic material. Such strips may be made rather thin and coincide with the meridians and parallels of latitude of the earth or other celestial bodies. Strips 42 may be glued or otherwise attached to inner surface 16 of curved member 12, FIG. 3. A light source 44 having a diffusing envelope 46 may be employed to illuminate or pass light through curve member 12 and plurality of pieces 26. In such a case, a silhouette would be formed on the outer surfaces of plurality of pieces 24, such as surface 32 of piece 26.

A measuring device 50 having a curved lower edge 52, matching the convex curve of surface 14, may be employed to determine distances along the outer surfaces of plurality of pieces 26 when they are assembled on the convex outer surface 14 of curved member 12.

In operation, the user places plurality of pieces 24 on convex outer surface 14 of curved member 12. Each of the plurality of pieces 24 includes a concave inner surface 30 which coincides generally with the curve of convex outer surface 14 of curved member 12. Plurality of pieces 24 may be held to curved member 12 by employing the mechanical support of shoulder 22 along edge 40 or by plurality of magnetic strips 42 being attracted to magnetic material strips found in each of the plurality of pieces 26 such as strip 36 of piece 26, FIG. 2. Source of light 44 may illuminate plurality of pieces 24 after assemblage and cast a silhouette thereupon. Such operation of device 10 would demonstrate meridian and parallels of latitude of the earth or other celestial bodies.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An puzzle apparatus. comprising:

a. a translucent curved member having a convex outer surface and a concave inner surface;

b. a plurality of translucent interlocking pieces, each of said plurality of interlocking pieces including a concave surface conforming to said convex outer surface of said curved member and a convex surface possessing indicia;

c. magnetic means for holding each of said plurality of interlocking pieces to said convex surface, said magnetic means comprising a multiplicity of opague strips of magnetic material and each of said plurality of interlocking pieces including magnetic material, said multiplicity of magnetic strips being placed in proximity to said convex outer surface of said curved member; and d. source of light placed adjacent said curved member such that light from said source shines through said curved member, said multiplicity of opague strips forming a silhouette on said outer surface of said curved member in conjunction with said source of light.

2. The apparatus of claim 1 which additionally comprises a base member surrounding said curved member.

3. The apparatus of claim 1 in which said curved member is substantially spheroid.

* * * * *